US010878664B2

(12) United States Patent
Zyxnfryx

(10) Patent No.: US 10,878,664 B2
(45) Date of Patent: Dec. 29, 2020

(54) ENTERTAINMENT MACHINE

(71) Applicant: Brandon Zyxnfryx, Nashua, NH (US)

(72) Inventor: Brandon Zyxnfryx, Nashua, NH (US)

( * ) Notice: Subject to any disclaimer, the term of this patent is extended or adjusted under 35 U.S.C. 154(b) by 76 days.

(21) Appl. No.: 16/171,417

(22) Filed: Oct. 26, 2018

(65) Prior Publication Data

US 2020/0134978 A1 Apr. 30, 2020

(51) Int. Cl.
*G07F 17/32* (2006.01)
*A63F 1/00* (2006.01)

(52) U.S. Cl.
CPC ..... *G07F 17/3293* (2013.01); *G07F 17/3223* (2013.01); *G07F 17/3234* (2013.01); *G07F 17/3288* (2013.01); *A63F 2001/003* (2013.01)

(58) Field of Classification Search
None
See application file for complete search history.

(56) References Cited

U.S. PATENT DOCUMENTS 5,465,974 A 11/1995 Adise
5,518,249 A 5/1996 Sines et al.
5,549,300 A 8/1996 Sardarian
5,636,842 A 6/1997 Cabot et al.
5,934,675 A 8/1999 Handelman et al.
6,302,396 B1 10/2001 Eaton et al.
6,612,580 B1 9/2003 Weldon
7,175,180 B2 2/2007 Webb
7,549,642 B2 6/2009 Centrone
7,637,506 B2 12/2009 Naicker
2009/0258689 A1 10/2009 Hedge, Jr. et al.
2011/0045887 A1* 2/2011 Munakata ..... G07F 17/32 463/12
2012/0169010 A1* 7/2012 Blaine ..... A63F 3/00157 273/292
2012/0252548 A1 10/2012 Love
2015/0151190 A1* 6/2015 Durbin ..... A63F 1/00 273/292
2015/0317882 A1* 11/2015 Ming ..... G07F 17/3225 463/11
2018/0322742 A1* 11/2018 Adams ..... G07F 17/3251
2019/0051102 A1* 2/2019 Atkinson ..... G07F 17/3288

FOREIGN PATENT DOCUMENTS

WO 0102068 1/2001
WO 2007112488 10/2007

* cited by examiner

*Primary Examiner* — Damon J Pierce
(74) *Attorney, Agent, or Firm* — Lambert Shortell & Connaughton; Gary E. Lambert; David J. Connaughton, Jr.

(57) ABSTRACT

An entertainment machine is provided. The machine provides a unique operation, wagering strategy, and structure. The entertainment machine provides optional and unique features, namely side bets. Such side bets may enhance pay out options as well as adjusting overall house edge in the game play. The entertainment machine may include networked embodiments to allow for multi-player engagement.

20 Claims, 4 Drawing Sheets

ENTERTAINMENT MACHINE

BACKGROUND OF THE INVENTION

Field of the Invention

The present invention relates generally to a gaming system. More particularly the present invention relates to a game and entertainment machine device providing strategic and advantageous modes of game play.

Description of Related Art

Blackjack is a common and popular gambling game played at casinos and elsewhere. This game largely involves seeking to be dealt cards close to or equal to 21 when the values of each card are added together, avoiding going over 21. However, over time, this game has grown stale. To increase variability, certain implementations of Blackjack allow users to engage in side bets such as "match" bet type wagers, where players may receive an additional payout if their cards match a dealer's cards. Indeed, in many instances players are more concerned with the side bets rather than the actual game of Blackjack.

Side betting is advantageous to the casino or dealer because it increases the overall bet size, and thus increases profit over time. Further, Blackjack as a game is comparatively slow, and it may be advantageous to a casino to provide an option for faster game play, to increase the rate of play, and thus increase the volume of betting. Faster game play is similarly advantageous to the player because it is more exciting and enjoyable.

Therefore, what is needed is an entertainment system which may highlight optional side betting, while simplifying and speeding up primary game play.

SUMMARY OF THE INVENTION

The subject matter of this application may involve, in some cases, interrelated products, alternative solutions to a particular problem, and/or a plurality of different uses of a single system or article.

In one aspect, an entertainment machine is provided. The entertainment machine has a data processor, a display in communication with the data processor, a user interface in communication with the data processor, and a computer memory configured to provide program instructions executable by the data processor. The memory is operable to cause the data processor to carry out a series of steps. Initially, the machine may receive a base wager input through the user interface. Further, the machine may receive a game play input from the player through the user interface. This game play input includes selection of one of a plurality of side bet wagers available to bet on. The processor then determines a dealing output to be dealt to a player and to a dealer based on a randomized set of available cards, the set of available cards being calculated by the processor based on a total number of cards in the deck(s) less any cards that have already been dealt in previous games before reshuffling. This dealing output will be displayed on the display as graphical representations of traditional playing cards, such graphical representations being stored in the memory. The processor uses this determined dealing output to calculate if a player has won or lost the base wager. The displaying is carried out by showing, on the display, graphical representations of two cards face up for the dealer, and two cards face up for the player. To win, a sum of the displayed player cards is greater than a sum of the displayed dealer cards. The player loses if the sum of the displayed player cards is less than or equal to the sum of the displayed dealer cards. In either instance, the processor is operable to cause the display to present either an indication of a payout if the player wins the hand, or an indication of no payout if the player loses the hand.

DETAILED DESCRIPTION

Figure 1:
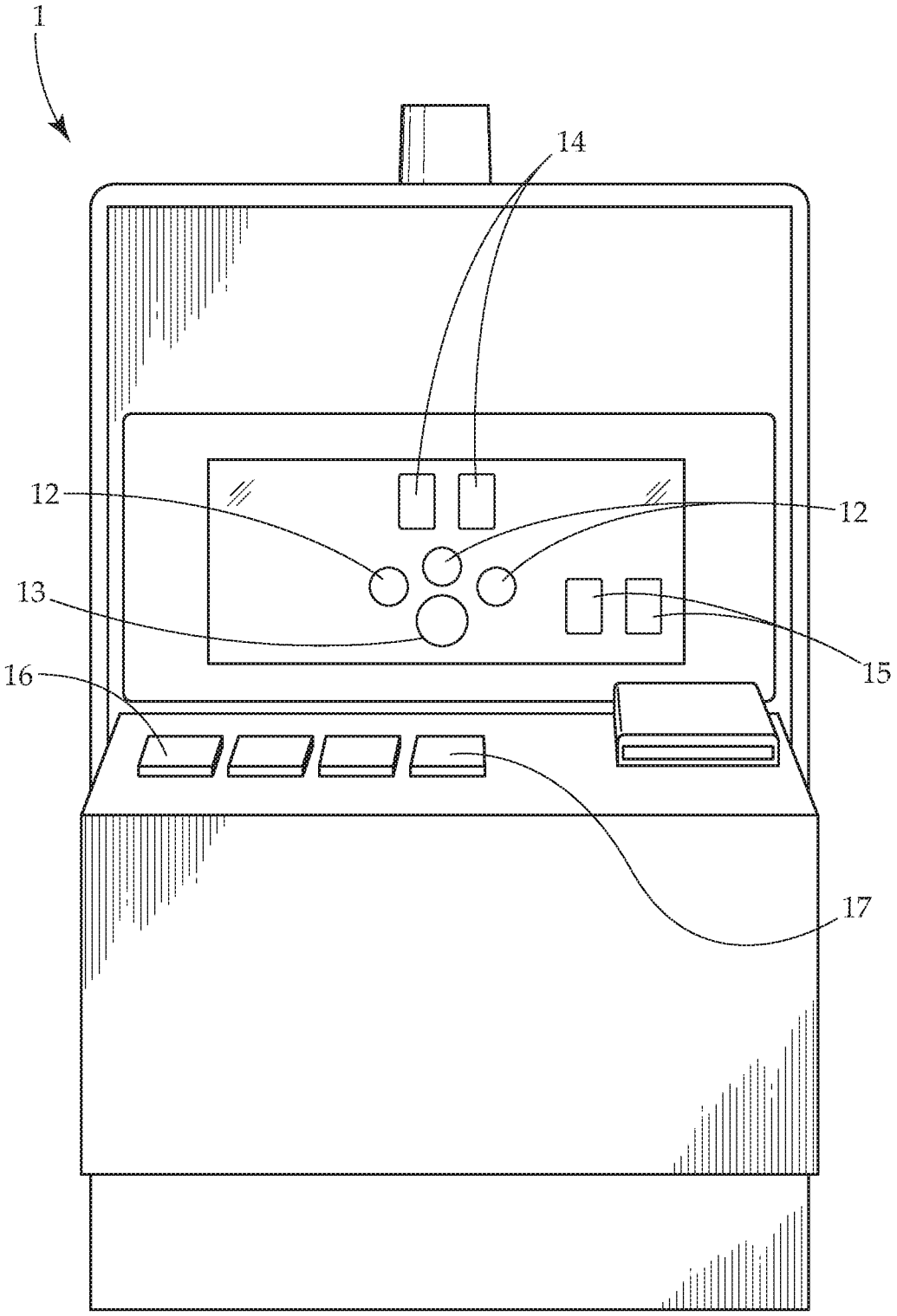
FIG. 1 provides a view of an entertainment machine of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, an entertainment system and entertainment machine device providing a unique operation, payout, programming and structure is provided herein. The entertainment system provides an exciting, entertaining, and engaging new system. The entertainment machine provides optional, unique game play features. These features may include a dealing series which involves dealing two cards each to all players and the dealer. If the player total of the two dealt cards is greater than the dealer's, that player wins. If the dealer's total of the two dealt cards is greater than or equal to the player, the dealer wins. Generally, the game play is carried out with a traditional deck of playing cards (two through ace), though a "Spanish" version may be used which takes out the "ten" card, and any other card deck may be used as well, without straying from the scope of the present invention. In traditional playing card deck embodiments and "Spanish" embodiments, a face card is worth ten points and an ace is worth eleven points. If a player is dealt cards which add to 21 or 22 (two aces), the player has "blackjack" and a base wager is paid 3:2. Otherwise, if the player total is greater than the dealer's the base wager is paid 1:1. If both player and dealer receive a blackjack, the hand is a push.

In various embodiments, the dealing may be carried out with one or more decks of traditional playing cards. In preferred embodiments, the dealing may be carried out with six, seven, or eight decks of cards. Adding or removing decks of cards adjusts the payout probability for the betting, both for the base strategy, as well as side bets, which are described below.

The present entertainment system may be carried out on the entertainment machine in one embodiment, and in other embodiments, may be carried out using a physical deck of cards and a unique playing board or table.

Unlike traditional blackjack games, no cards are drawn after the initial hand has been dealt. This removes player decisions making after a wager has been made and results in faster play. Absence of card drawing also eliminates the possibility of a "bust" where a player (or dealer) draws cards which add to greater than 21. This speed increase compared to traditional Blackjack causes an advantage to both the casino/house and players through a simple, exciting, and engaging pace.

The entertainment system allows for various side bets. For example, such wagers include a plurality of Match the Dealer bets or a "Mirror Match", where a player wins if their two cards are the same, such as being dealt two Aces. In a certain implementation, a wager may be made to match a first-dealt card of the dealer, and/or to match the second-dealt card of the dealer. In this embodiment, a first-dealt card match may be called a "Match 1" wager, and a second-dealt card match may be called a "Match 2" wager. In such match wager embodiments, payout is adjusted depending on how close the match is—for example, matching the number provides one payout ratio; while matching the number and suit provides another higher payout ratio (because it is less likely to occur). The present invention was developed having observed a demand for "match bet" type wagers, and the realization that players are more concerned with the matching rather than the actual strategy of reaching a score of 21. Examples of the payouts and house edge for the base strategy and side bets are shown in Tables 1A-F, below.

TABLE 1A

Payouts of base wager.

| Player Total | Dealer Total | Result |
|---|---|---|
| Blackjack | Does Not Have Blackjack | 3:2 |
| Blackjack | Blackjack | Push |
| Higher | Lower | 1:1 |
| Lower | Higher | Lose |
| Same | Same | Lose |

TABLE 1B

House edge for base wager.

| Decks | Six (6) | Seven (7) | Eight (8) |
|---|---|---|---|
| Standard | −4.36% | −4.36% | −4.36% |
| Spanish | −4.30% | −4.30% | −4.30% |

TABLE 1C

Payouts of mirror match wager.

| Player Cards | Standard Result | Spanish Result |
|---|---|---|
| Mixed color pair | 5:1 | 5:1 |
| Same color pair | 12:1 | 10:1 |
| Same suit pair | 25:1 | 25:1 |
| Suited Aces | 40:1 | 30:1 |

TABLE 1D

House edge for mirror match wager.

| Decks | Six (6) | Seven (7) | Eight (8) |
|---|---|---|---|
| Standard | −8.11% | −6.91% | −6.01% |
| Spanish | −5.89% | −4.63% | −3.68% |

TABLE 1E

Payouts for match the dealer wager.

| Player Cards | Standard Result | Spanish Result |
|---|---|---|
| 2 Suited Matches | 22:1 | 18:1 |
| 1 Suited and 1 Non-Suited Match | 15:1 | 13:1 |
| 1 Suited Match | 11:1 | 9:1 |
| 2 Non-Suited Matches | 8:1 | 8:1 |
| 1 Non-Suited Match | 4:1 | 4:1 |
| No Matches | Lose | Lose |

TABLE 1F

House edge for match the dealer.

| Decks | Six (6) | Seven (7) | Eight (8) |
|---|---|---|---|
| Standard | −4.06% | −3.01% | −2.23% |
| Spanish | −3.06% | −2.12% | −1.42% |

The entertainment machine is formed generally by a machine body, which provides a housing and structure for the entertainment machine. On and in this body is an interface, which allows input into the machine and output to a player of the machine. The input includes a money or payment input (generally referred to herein as a payment input), which may be a card reader, cash input slot, electronic payment input, or the like. A betting input is also present as part of the interface. The betting input allows a user to select a wager quantity and/or type, such as a minimum bet, and/or selection of one or more side bets. A display output is provided as part of the interface. This may be a computer display screen, or the like. Further, within the housing and as part of a control system of the machine is a randomizer. The randomizer is configured to provide a random result based on the possible options in a deck of cards or "shoe" in the common case of multiple decks being shuffled together (taking into account cards that have already been dealt). This randomizer may be electronic, such as a programmed computerized random number generating module carried out by a data processor, or may be a mechanical structure that controls a dealing of a deck of cards (either a physical deck or electronic deck). In another embodiment, the computerized system may be programmed, as stored in the memory, to follow odds and payouts calculated from the tables above, to ensure that over a certain time period, such as one day, two days, one week, one month, or the like, that the payouts are correct. The interface further has a payout output, which provides a way for a player to receive a payout. This may be through a printed ticket, electronic credit, cash output, and the like.

In electronic versions of the present invention, a computer having a computerized data processor controls the game play of the machine. The randomizer may be a programmed module, such as an instruction set executable by a data processor, stored in a memory. The computer may be further configured to receive inputs from the interface, and provide output through at least a display screen and, optionally, through other outputs such as lights and/or speakers. In one embodiment, the display may be a touch screen, such that it also may receive inputs such as those noted above. Such electronic versions of the present invention may include a computerized entertainment machine, and may also be in the form of fully digital implementations such as a computerized implementation playable on a computer such as a tablet, smartphone, kiosk, desktop or laptop computer, as well as network based embodiments, internet embodiments, or application embodiments.

In further detail, an embodiment of entertainment machine contemplated herein may comprise a data processor. The processor may be in communication with a display, a player interface, as described above, and a memory device. The memory device may contain the randomizer module, as well as electronic representations of the cards, game layout, and related graphics, for presentation by the display. The memory may further contain program instructions, in addition to the randomizer module's instructions. These instructions are executable by the data processor to conduct the steps of the game play, as will be detailed below.

One aspect of the invention may also include a non-transitory computer readable medium having instructions allowing and instructing the data processor to carry out the steps required during game play of the entertainment machine, as described herein. This non-transitory computer readable medium may be stored within the housing of the entertainment machine, or may be accessible through an electronic communication system such as a network and/or internet connection.

The entertainment system in the present invention may be played with one dealer and at least one player. In certain machine based embodiments, a networked operation to allow multiple players on different machines to engage in the same session. This may provide an enhanced social aspect to the entertainment machine. In such embodiments, a computerized network connection connects the memory and processor of the entertainment machine to the internet, local area network, and/or other entertainment machines directly. The networked connection may provide an input to a particular entertainment machine, and this input may cause the processor to display a hand and optionally bets of a networked user playing on that different entertainment machine on the display of the entertainment machine.

Turning now to FIG. 1, a view of an entertainment machine of the present invention is shown. The entertainment machine 1 has a body which contains the internal components (not shown). The entertainment machine comprises a number of interface elements 16, 17, and in some instances touch screen display 11, as well as buttons or other inputs to activate certain side bets, and base wager. The machine 1 comprises a payment input 18 to receive wagers, and payout slot 19 to receive a payout, if any, when ending game play. A display 11 is in communication with the computerized internal components, as discussed above. The display provides a visual output and feedback as the dealing and win/loss results progress.

As shown, the display 11 shows the dealer cards 14, player cards 15, and bet statuses 12, 13. In this embodiment, the bet statuses are graphical representations of "chips" and chip placement areas to mimic traditional casino game play. Upon certain inputs such as through buttons 16, 17 and/or touch gestures to the display 11, the display 11 will change the bet statuses 12, 13, and optionally trigger "dealing" of graphical representations of cards, displayed on the display 11, by the machine. Input into the machine includes a base wager, and an input selecting one of a plurality of optional side bet wagers. The dealing involves the processor determining, using the randomizer or other programming, what cards will be displayed for the dealer 14 and player 15, and then displaying graphical representations of these cards on the display. Whether the player has won or lost both the base wager and any side bets is determined by processor calculation and presented on the display 10 using a graphical representation. After one hand has completed, the player may elect to play another hand or not. It should be understood that all of the inputs and outputs are in communication with the computerized system as noted above. Namely, the microprocessor, which can receive inputs and provide outputs depending on operation.

Figure 2:
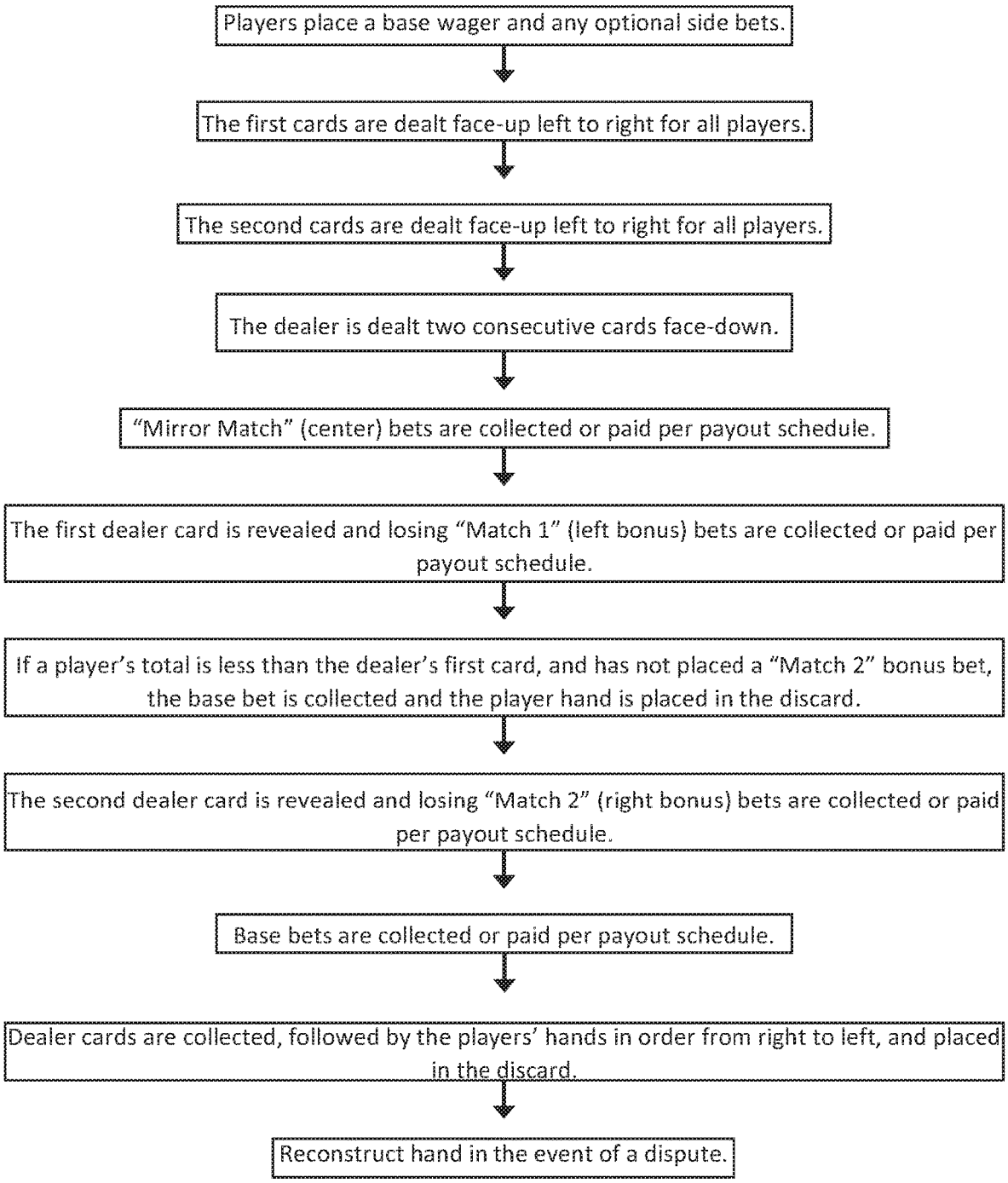
FIG. 2 provides a flow chart of an embodiment of operation of the present invention.

FIG. 2 shows a flow chart of an embodiment of the steps of the entertainment system progression. Initially, the player or players place their base wager and optional side bets. The cards are then dealt face up with one card left to right to every player, then a second card left to right for every player. The dealer is then dealt two consecutive cards face down after the player(s) have been dealt to. Any mirror match bets can now be resolved based on what cards are showing for each player. A first dealer card is then revealed, and any corresponding side bets are collected or paid per the payout schedule. In the event that the sum of a player's cards are less than the dealer's first shown card (for example, player has two four's, but the dealer's first card is a ten), and if the player has not placed a Match 2 side bet, the base bet is collected and the player's hand is discarded as a loss. The second dealer card is then revealed and any losing side bets are collected or paid per the payout schedule. Base bets are then collected or paid per the payout schedule. Finally, dealer cards are collected, followed by the players' hands in order from right to left, and placed in the discard. Such an ordered collection allows for reconstruction of the hand in the event of a dispute.

Figure 3:
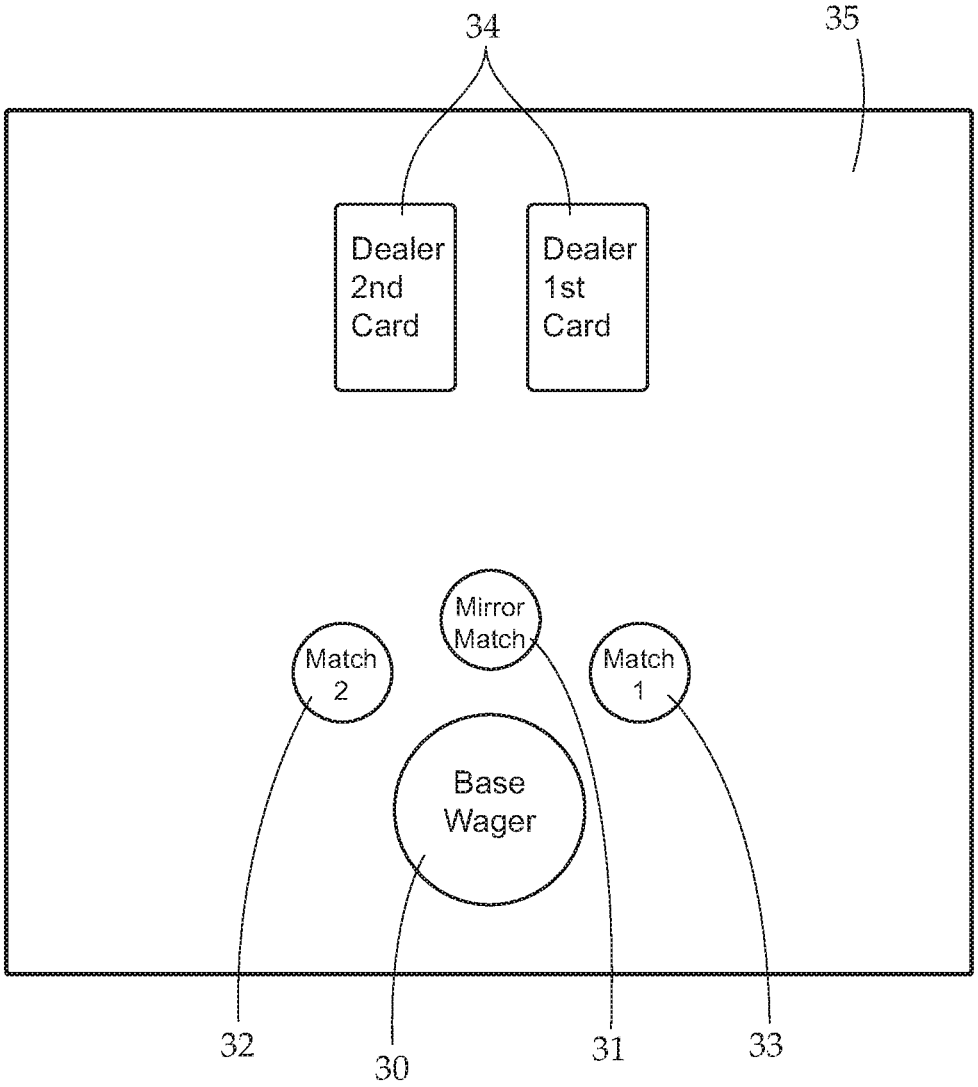
FIG. 3 provides a view of a board for use of the present invention.

FIG. 3 shows an embodiment of a board (either physical or an electronic representation thereof) on which the entertainment system may be carried out. The board 35 provides a surface or area for the cards and bets to be placed/displayed. Dealer cards are displayed in the first and second area 34. Player cards may be displayed anywhere on the board 35 in this embodiment. In other cases, (not shown) the player cards may be displayed on a defined player card area. A base wager area 30 is where a user places or displays their betting chips for the base wager for each hand. A match one wager area 33 allows a player to place a wager that one of their cards will match the first-revealed of the dealer's cards. A match two wager area 32 allows a player to place a wager that one of their cards will match the second-revealed of the dealer's cards. A mirror match wager area 31 allows a player to place a wager that both of their cards will match. In touch screen embodiments of the entertainment machine, a gesture corresponding to the match one wager area 33, match two wager area 32, and mirror match wager area 31 allows input of a selection to make this wager and input a wager amount.

Figure 4:
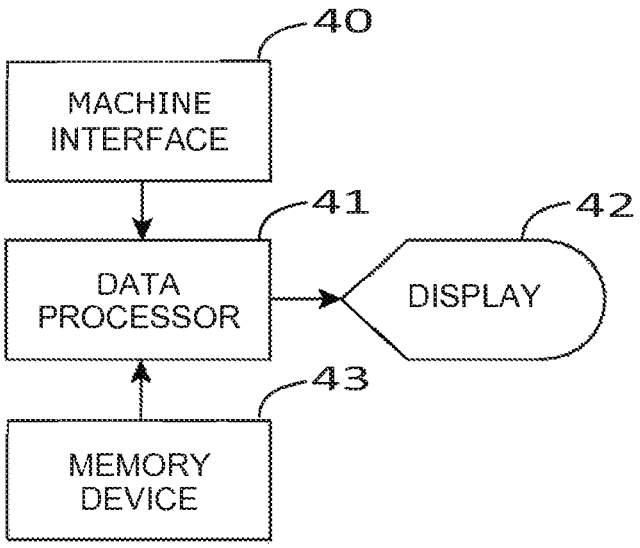
FIG. 4 provides a simplified schematic view of an embodiment of the computerized communication of the entertainment machine.

FIG. 4 provides a simplified schematic view of an embodiment of the computerized communication of the entertainment machine. The entertainment machine interface 40 has elements as described above. These elements communicate with data processor 41. The data processor 41 is further in communication with a memory 43 which stores instructions for the data processor 41, as well as calculations and determinations by the data processor 41. A display 42 provides a visual output of the results, and any other information that the data processor 41 is instructed to output.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An entertainment machine for conducting an entertainment system comprising:

a data processor;

a display in communication with the data processor;

a user interface in communication with the data processor; and a computer memory, wherein the computer memory is configured to store program instructions executable by the data processor to conduct the steps of:

receiving an input from the player regarding a base wager through the user interface;

receiving a game play input from the player through the user interface, the game play input selecting one of a plurality of side bet wagers available on the machine stored on the memory;

determining a dealing output to be displayed on the display and to determine if a user has won or lost a hand, the determining comprising calculating, based on programming, only two cards per hand based on a total number of available cards in a shoe of playing cards less a quantity of previously-dealt cards, the dealing output determining that the user has won or lost the hand based on the only two cards per hand;

receiving an actuation through the user interface;

displaying a hand of at least a player and a dealer as determined by the determining step, each of the player hand and dealer hand comprising only two cards of a standard deck of playing cards;

presenting a payout on the display if the processor calculates a sum of the displayed only two player cards is greater than a sum of the displayed only two dealer cards and presenting that there is no payout on the display if the processor calculates the sum of the displayed player cards is less than or equal to the sum of the displayed dealer cards wherein the step of each player hand and dealer hand comprising only two cards of the standard deck of playing cards allows for a fast game play; and wherein the data processor is further operable to carry out the step of checking a quantity of games played and payouts made by the machine in a predetermined time period, and comparing these payouts to an expected odds and payout rate data stored in the memory to ensure the odds and payouts are correct.

2. The entertainment machine of claim 1 further comprising the step of receiving at least one of a plurality of side bet wagers through the interface;

presenting, on the display, that the at least one of a plurality of side bet wagers are received, the presenting comprising a visual indication on at least one predetermined bet status area of the display;

determining, using the data processor, if the player has won at least one of the side bet wagers; and presenting a second payout on the display based on the determining if the player has won the at least one side bet wager.

3. The entertainment machine of claim 2 wherein the display is a touch screen.

4. The entertainment machine of claim 3 wherein the input and the game play input are each received by a gesture input to the touch screen corresponding to a graphically defined area on the touch screen.

5. The entertainment machine of claim 1 wherein one of the at least one side bet wagers is determined a win if one of the two player cards matches a first of the two dealer cards.

6. The entertainment machine of claim 5 wherein one of the at least one side bet wagers is determined a win if one of the two player cards matches a second of the two dealer cards.

7. The entertainment machine of claim 6 wherein one of the at least one side bet wagers is determined a win if both of the two player cards matches each other.

8. The entertainment machine of claim 7 wherein the display is a touch screen.

9. The entertainment machine of claim 8 wherein the game play input is received by receiving a gesture at an area corresponding to an area graphically defined on the touch screen display for each of the at least one side bet wagers.

10. The entertainment machine of claim 1 wherein one of the at least one side bet wagers is determined a win if one of the two player cards matches a second of the two dealer cards.

11. The entertainment machine of claim 1 wherein one of the at least one side bet wagers is determined a win if both of the two player cards matches each other.

12. The entertainment machine of claim 1 further comprising a networked connection providing a networked communication to the processor and the memory.

13. The entertainment machine of claim 12 wherein the entertainment machine is in networked communication with a plurality of other entertainment machines, and wherein the program instructions further instruct the processor to conduct the steps of:

communicating the determined dealing of the player to each of the plurality of other entertainment machines;

receiving, through the network, a calculated dealing output of each of a plurality of players corresponding to each of the plurality of entertainment machines; and displaying the received dealing outputs on the display.

14. The entertainment machine of claim 12 wherein the networked connection is an internet connection.

15. The entertainment machine of claim 1 further comprising an electronic card reader in communication with the data processor, the electronic card reader providing a payment input for the base wager and at least one side bet wager.

16. The entertainment machine of claim 15 further comprising a payment output.

17. The entertainment machine of claim 16 wherein the payment output being one of the electronic card reader operable to credit a payment to a player, or a separate payment output in a body of the machine.

18. The entertainment machine of claim 1 further comprising a networked connection providing a networked communication to the processor and the memory of a plurality of additional entertainment machines; and wherein the data processor being operable to carry out the step of determining the dealing output further comprises determining the dealing output for a plurality of hands for each of the plurality of additional entertainment machines, by the data processor, and transmitting, through the networked connection, the determined dealing output to each of the plurality of machines.

19. The entertainment machine of claim 18 wherein the data processor is further operable to carry out the step of displaying each of the determined dealing outputs corresponding to each of the plurality of machines on the display.

20. The entertainment machine of claim 1 wherein the data processor is configured to calculate a payout to the player, and wherein the payout is paid at a ratio of three to two of the base wager if the player receives a deal having a sum equal to 21 or 22, and the dealer did not receive a deal having a sum equal to 21 or 22.

* * * * *